US006565925B1

(12) United States Patent
Pleschiutschnigg

(10) Patent No.: US 6,565,925 B1
(45) Date of Patent: May 20, 2003

(54) METHOD AND DEVICE FOR PRODUCING COATED METAL STRANDS, ESPECIALLY STEEL STRIPS

(75) Inventor: Fritz-Peter Pleschiutschnigg, Duisburg (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/889,521

(22) PCT Filed: Jan. 7, 2000

(86) PCT No.: PCT/EP00/00060

§ 371 (c)(1),
(2), (4) Date: Jul. 18, 2001

(87) PCT Pub. No.: WO00/43563

PCT Pub. Date: Jul. 27, 2000

(30) Foreign Application Priority Data

Jan. 20, 1999 (DE) ..... 199 02 066

(51) Int. Cl.[7] ..... B05D 1/18; B05D 3/12; B05D 3/02; B05C 3/12

(52) U.S. Cl. ..... 427/434.7; 427/431; 427/436; 427/443.2; 427/319; 427/349; 427/357; 427/359; 118/405; 118/419; 118/423; 118/428; 118/429

(58) Field of Search ..... 427/431, 433, 427/434.6, 434.7, 436, 443.2, 319, 357, 349, 359; 118/405, 419, 423, 424, 428, 429

(56) References Cited

U.S. PATENT DOCUMENTS 4,339,480 A * 7/1982 Stavros et al. ..... 118/420
5,722,151 A * 3/1998 Pleschiutschnigg et al. 118/620
5,855,238 A 1/1999 Pleschiutschnigg et al.
5,965,210 A * 10/1999 Tada et al. ..... 118/405
6,037,011 A * 3/2000 Deegan et al. ..... 427/310

FOREIGN PATENT DOCUMENTS

DE 3600548 7/1987
DE 196 38 905 C1 1/1998

* cited by examiner

*Primary Examiner*—Michael Barr
(74) *Attorney, Agent, or Firm*—Friedrich Kueffner

(57) ABSTRACT

A method for producing coated strands of metal includes guiding a metal strand through the bottom of a vessel filled with a molten mass of the same or different composition as the metal strip, wherein the residence time of the metal strand is selected as a function of at least one of the molten bath level, the casting speed, the metal strand thickness, and the preheating temperature of the metal strand such that the deposited molten mass on the metal strand has a desired thickness of several times the initial thickness of the metal strand. After exiting from the molten bath, the metal strand with a layer crystallized thereon is subjected to a smoothing path carried out when the surface temperature of the strand crystallized thereon is smaller than the solidus temperature of the molten bath, so that at least the surface of the layer crystallized thereon is solidified. The crystallized layer is applied with a thickness which exceeds the desired final thickness of the coated strand. Between the molten bath and the beginning of the solidification while still in the doughy state of crystallization, stripping of the crystallized layer is carried out to a controlled uniform smaller thickness over the length of the strand.

10 Claims, 3 Drawing Sheets

METHOD AND DEVICE FOR PRODUCING COATED METAL STRANDS, ESPECIALLY STEEL STRIPS

BACKGROUND OF THE INVENTION

1. Field of the Invention

The invention relates to a method and a device for producing coated strands of metal, in particular, of strips of steel, wherein a metal strand is guided through the bottom of a vessel, filled with a molten mass of identical or different composition as the metal strand, wherein the residence time of the metal strand is selected as a function of the molten bath level, the casting speed, the metal strand thickness, and the preheating temperature of the metal strand such that the deposited molten mass on the metal strand provides a desired thickness of a multiple of the initial thickness of the metal strand and the metal strand with the layer partially crystallized thereon is subjected to a smoothing pass after exiting from the molten bath which is performed when the surface temperature of the partially crystallized strand is lower than the solidus temperature of the molten bath and thus at least the surface of the partially crystallized layer is solidified.

2. Description of the Related Art

In a method and device known from EP 0 832 990 A2 a disadvantage in the production of coated metal strands, preferably strips of one steel quality or different steel qualities, such as, for example, single material or composite material and in this connection particularly also composite material of carbon steel, finely coated with stainless steels, is eliminated. A disadvantage in such inversion casting devices for a partially crystallized layer with a "doughy surface and doughy core" was found to be that the layer adhering to the mother strand, on the one hand, has solidified already to a relatively large degree but, on the other hand, its outer zone still contains sufficient proportions of liquid phase when entering the smoothing roller pair. The strand is then subjected during its pass through the smoothing roller pair to a great supercooling so that there is a tendency of crack formation in the longitudinal as well as transverse directions of the strip. This risk increases even more for higher casting and rolling speeds. Accordingly, in this situation, the smoothing pass is performed when the surface temperature of the crystallized strand is smaller than the solidus temperature of the molten bath and thus at least the surface of the crystallized layer is solidified. However, it still cannot be prevented that the thickness of the partially crystallized layer fluctuates.

SUMMARY OF THE INVENTION

The invention has therefore the object to provide a method and a device which ensure smoothing of the strip with a strip thickness tolerance of a maximum of 2% without crack formation in the surface as well as in the interior of the strip with simultaneous thickness control of the partially crystallized layer.

In accordance with the present invention, a method for producing coated strands of metal includes guiding a metal strand through the bottom of a vessel filled with a molten mass of the same or different composition as the metal strip, wherein the residence time of the metal strand is selected as a function of at least one of the molten bath level, the casting speed, the metal strand thickness, and the preheating temperature of the metal strand such that the deposited molten mass on the metal strand has a desired thickness of several times the initial thickness of the metal strand. After exiting from the molten bath, the metal strand with a layer crystallized thereon is subjected to a smoothing path carried out when the surface temperature of the strand crystallized thereon is smaller than the solidus temperature of the molten bath, so that at least the surface of the layer crystallized thereon is solidified. The crystallized layer is applied with a thickness which exceeds the desired final thickness of the coated strand. Between the molten bath and the beginning of the solidification while still in the doughy state of crystallization, stripping of the crystallized layer is carried out to a controlled uniform smaller thickness over the length of the strand.

The main features of producing flawless, planar-coated strips, for example, of a width/thickness ratio of greater 60 and a total thickness of a maximum of 12 mm, preferably 2 to 6 mm, of one material or composite materials of different metal qualities such as carbon steel as a single material or carbon steel with a stainless steel coating of at least 5% of the total strip thickness as a composite material and a thickness fluctuation of a maximum of 2% between the edge (40 mm from the edge) and the center of the strip, are characterized with respect to the desired goal of a uniform thickness of the partially crystallized layer particularly in that, between the molten bath and the beginning of solidification on the strip surface, a stripping off of the partially crystallized layer of a desired thickness to a smaller thickness is carried out. The final effect thus is that only that much material is stripped off or removed as is required in order to obtain a uniform thickness of the partially crystallized layer across the length of the strand. Accordingly, the excess of the partially crystallized layer is stripped off.

Stripping off the partially crystallized layer with a desired thickness to a smaller thickness is carried out according to the device advantageously between the molten bath and the beginning of solidification on the strip surface, wherein the walls of the chamber receiving the smoothing roller pair as well as the smoothing rollers themselves are embodied to be heat-controlled. For stripping off, mechanical stripping devices in the form of preferably blades are advantageously provided; alternatively, a pneumatic stripping device can be employed.

BRIEF DESCRIPTION OF THE DRAWINGS

In FIGS. 1 through 3 the invention is illustrated with respect to the method as well as the device. It is shown in:

FIG. 1 an overview of the method and its device for smoothing coated strands of metal, preferably strips of steel;

FIG. 2 a temperature field of the strand between the strip entry into the crystallization device and the smoothing roller pair during casting;

FIG. 3 a coated strip between the molten bath surface in the crystallization device and the smoothing roller pair; detail of FIG. 1.

DESCRIPTION OF THE PREFERRED EMBODIMENTS

Figure 1:
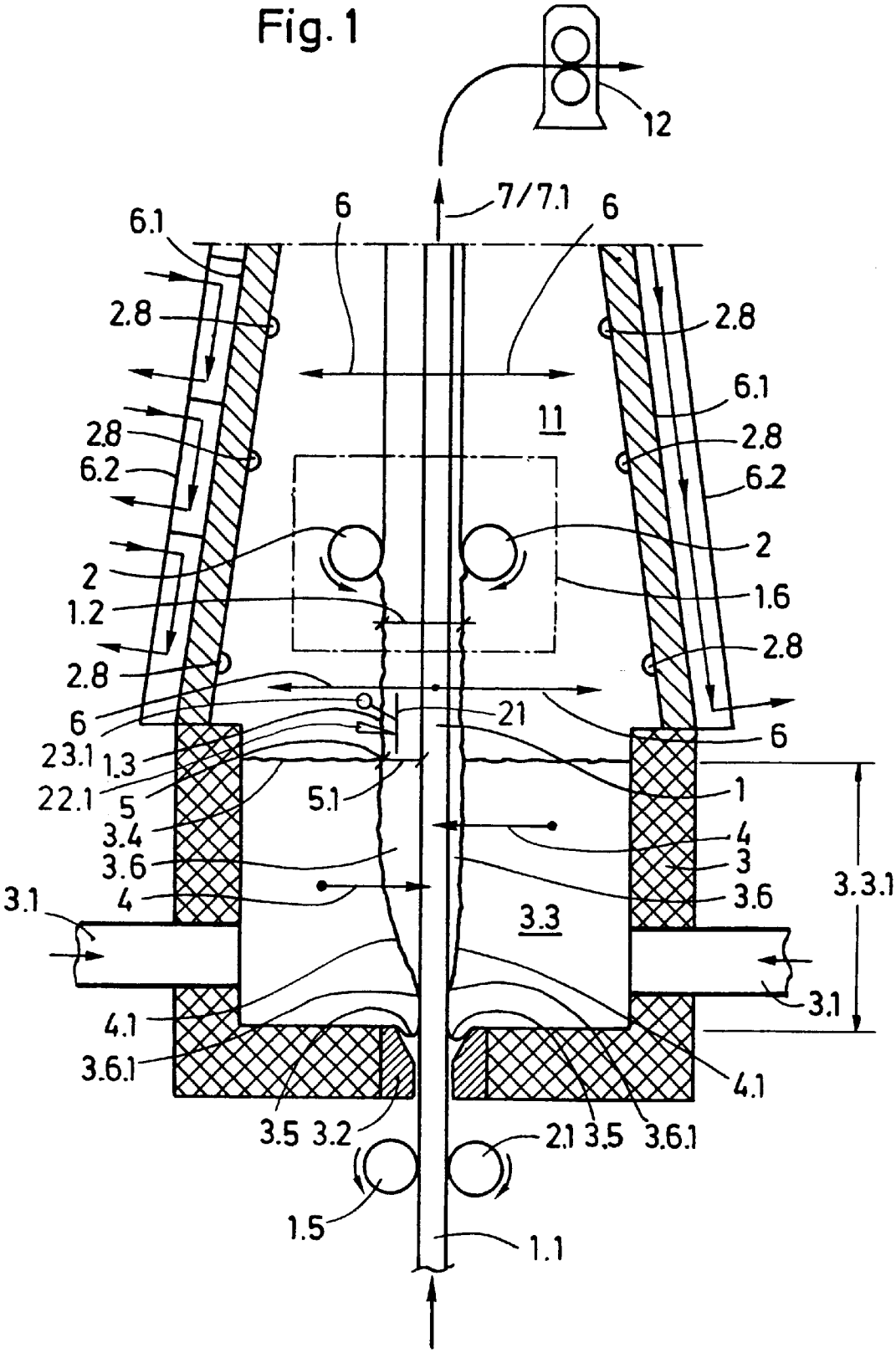
Figure 2:
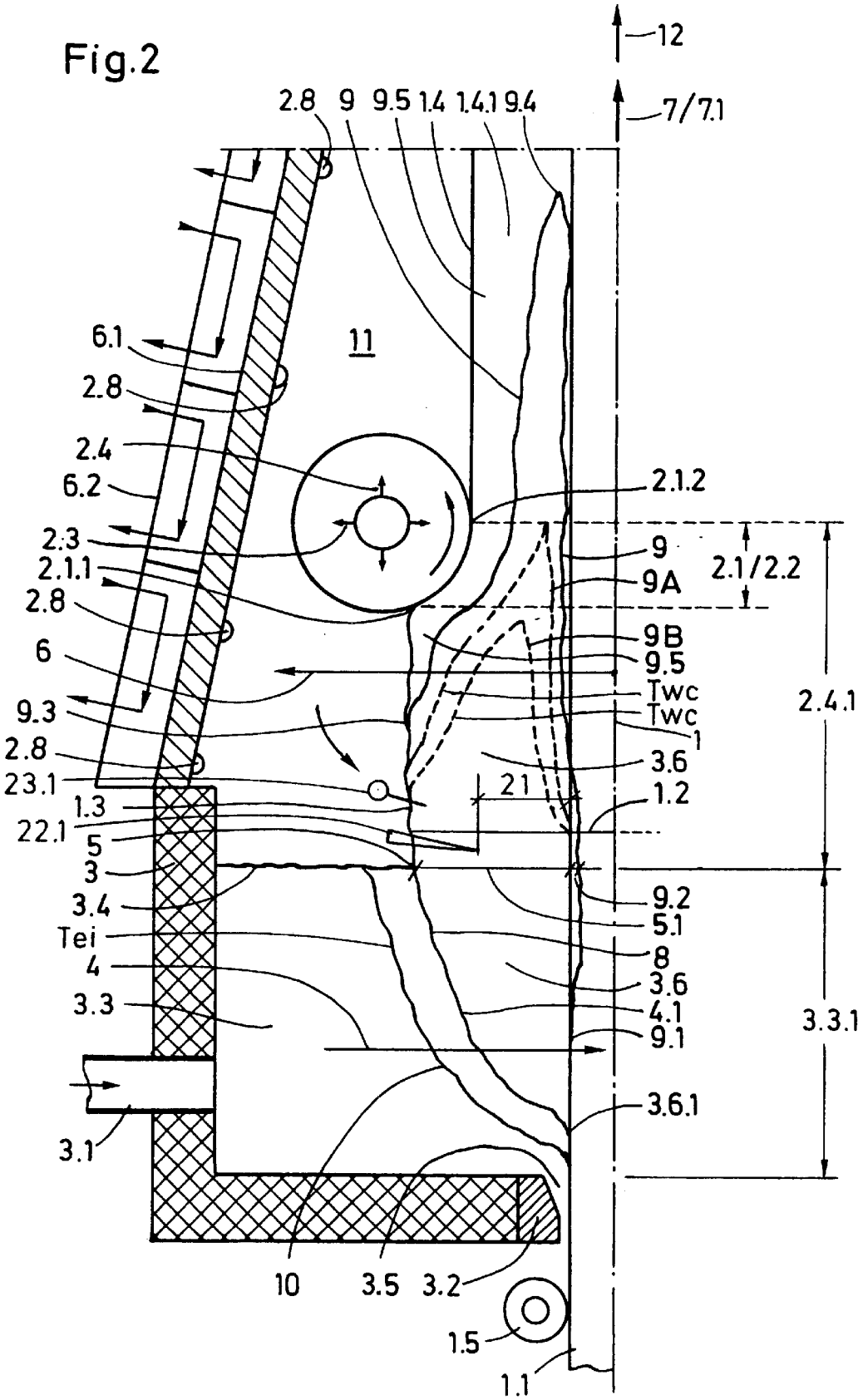

FIGS. 1 and 2 show an overview of the method and the device for smoothing coated strands, preferably strips of steel 1, by means of a smoothing roller pair 2. The mother strip 1.1 is transported into the crystallization device 3, filled with molten mass 3.3 which is introduced via a molten mass inlet 3.1, through the nozzles of a bottom inlet device 3.2 with a casting and rolling speed 7.1 of 0.05 to 10 m/s by means of a drive roller pair 1.5 underneath the crystallization device.

On the mother strip 1.1 with a temperature of 20 to 80° C. as desired before entry into the crystallization device 3, a partial crystallization 3.6 of the molten mass begins at the point 3.6.1 above the steel meniscus 3.5 at the nozzle exit 3.2, and the mother strip 1.1 removes from the molten mass 3.3 overheating energy and crystallization energy while being heated up simultaneously. This energy flow 4 from the molten mass into the mother strip takes place between the meniscus 3.5 and the bath surface 3.4 across the molten bath level 3.3.1 when the mother strip passes through the molten bath 3.3. When exiting 5 from the bath surface 3.4 of the molten bath, the coated strand 1 having a surface roughness 1.3 has reached a certain thickness 1.2, which is substantially determined by the strip temperature when entering the crystallization device, the melting temperature, and the contact time of the strip with the molten mass, with which thickness the strip 1 enters the roller gap 2.1 of the smoothing roller pair 2.

The strand 1 coated in this way has a "doughy" surface (two phases: melt and crystal) when exiting 5 from the bath 3.4 and has a surface roughness 1.3 of greater than 2% which does not comply with the criteria for being plane of a strip with a width/thickness ratio of greater than 60.

When the coated strip 1 exits from the bath 3.4 with the final thickness 5.1, the solidification takes place from the exit point 5 up to the smoothing roller pair 2 and, moreover, in the partially crystallized layer, which is comprised of molten mass and crystal, from the exterior to the interior, i.e., the energy flow 6 is reversed in comparison to the heat flow 4 in the molten mass 3.3 and extends from the interior (strip center) to the exterior into the walls 6.1 with the heat-controlled transfer. This controlled heat flow can be divided by wall elements 6.2 into corresponding zones, required for temperature control of the strip 1, in the casting and rolling direction 7. These device features make it possible to govern the heat flow 6 from the strip to the heat transfer-controlled walls 6.1 and 6.2, i.e., to control it or to adjust it as a function of the steel quality, the casting speed 7.1, and the position 2.4 of the smoothing roller pair 2.

For describing and for understanding the surprising solution which constitutes the invention, it is also required to control the temperature fields and thus the phase conditions of the coated strip 1 in interaction with the heat flows 4.6 and 2.7 from the molten mass 3.3 into the mother strip 1.1, from the coated strip 1 into the walls with the heat-controlled transfer 6.1 between the bath surface 3.4 and the smoothing roller pair 2 as well as, moreover, from the coated strip 1 in the roller gap 2.1 of the smoothing roller pair 2 via the roller body into the inner cooling device 2.5 of the smoothing roller pair.

The partial crystallization layer 3.6 in the bath 3.3 has at its surface 4.1 a temperature 8 (T-x) which is greater than the solidus temperature and lower than the liquidus temperature (T-li>T-x>T-sol) and has a two phase state, comprised of molten mass and crystal. The temperature of the partial crystallization layer decreases continuously from the surface perpendicularly to the mother strip 1.1. As a function of the surface profile 4.1 of the partial crystallization layer 3.6, the liquidus isothermal line 10 extends in the molten bath up to the bath surface 3.4.

Upon emerging of the coated strip 1 from the bath 3.4 at the location 5, the molten layer 9.1 of the mother strip 1.1 is greatest which molten layer began in the molten bath 3.3 at the location 9.1 upon reaching the solidus temperature. The beginning of this melting of the mother strip starts the welding between the mother strip 1.1 and the layer 3.6 crystallized thereon.

Above the molten mass, with reversal of the energy flow 6, the solidification of the residual molten mass begins in the layer crystallized thereon, comprised of the phases molten mass and crystal, from the surface of the strip 1 perpendicularly in the direction of the strip center as well as the surface itself in the direction of the smoothing roller pair 2 parallel to the casting and rolling direction 7, i.e., the surface temperature of the strip decreases, beginning at the bath surface 3.4 at the location 5 in the direction of the smoothing roller pair 2, in a continuous fashion, passes the solidus temperature at the point 9.3 before the coated strip 1 enters 2.1.1 into the smoothing roller pair 2 where it then reaches a value which is below the T-solidus.

Moreover, the thickness 1.2 of the coated strip between the strip surface 3.4 and the beginning of the solidification 9.3, i.e., still within the "doughy" (two phases: molten mass and crystal) strip surface area 24, is reduced to a smaller thickness 21 by stripping 20. This reduction must be carried out before complete solidification 9.3 takes place in order to obtain a clean and planar strip surface.

This stripping 20 or control of the coating thickness can be carried out alternatively with a mechanical stripper 22 (blade), which is comprised of metal and/or ceramic material and may also be cooled, or with a pneumatic stripper which is operated with an oxygen-free gas jet 23.

Moreover, both types of strippers 22 and 23 can be used successively. Moreover, the position of both strippers, i.e., their spacing to the strip surface 1.3, to the bath surface 3.4, as well as relative to one another, can be freely selected.

For regulating a desired temperature control of the coated strip 1, the position 2.4 of the smoothing roller pair 2, the energy flow 6 into the walls with heat-controlled transfer 6.1 and 6.2, and the casting and rolling speed 7.1 are to be governed according to the meaning of the invention such that the surface temperature of the coated strip 1 before entering the smoothing roller pair 2 is below the solidus temperature so that the coated strip is solidified at least at its surface.

This condition is mandatory for a crack-free surface because the solidified phase particularly immediately below the solidification has a distinct extension behavior without crack formation. In contrast to this good extension behavior of the material "steel"immediately below the solidification point, T-solidus, it is known that the deformation limit within the "doughy" area, in the two-phase area melt/crystal, and thus the avoidance of cracks is very small and, depending on the steel quality, is between 0.1 to 0.3%.

In so-called inner-crack-sensitive steel qualities, i.e., steels which in the "doughy" area have a tendency to generate cracks even for minimal deformations, i.e., tensile stress, it is important for the inventive method that the solidification profile 9 at the phase boundary solid/liquid is controlled such that the solidification 9.4 of the coated strand 1 is terminated at the latest at the exit 2.1.2 and 9A of the roller gap, respectively, at the latest at the inlet 2.1.1 and 9B into the roller gap of the smoothing roller pair 2.

These conditions of the coated strip 1 in the smoothing roller pair, for a preset casting speed 7.1, can be adjusted by means of the control of the heat flows 6 and 2.7 by means of the wall elements 6.1 and 6.2 and/or the smoothing roller pair 2 with inner cooling device 2.5, adjustable in its position relative to the casting level 2.4.1.

When ensuring a strip 9.5 solidified at least within the surface area in the roller gap 2.1 with the compressed length 2.2, the strip 1 with its rough surface 1.3 can be rolled or smoothed 1.4 with thickness reductions of up to 20% by adjusting the smoothing roller pair 2 in the thickness direction 2.3 without surface cracks or inner cracks in the layer crystallized thereon occurring while simultaneously a good welding between the mother strip 1.1 and the layer 3.6 crystallized thereon is ensured. The thus smoothed and planar strip 1.4.1 is without cracks in its surface 1.4 and in the interior of its solidified, completely crystallized layer 3.6. The planar property and the resulting profile of the strip 1.4.1 can be adjusted with the above described features according to the invention with a tolerance of a maximum of 2% of the thickness in the transverse and in the longitudinal directions.

Figure 3:
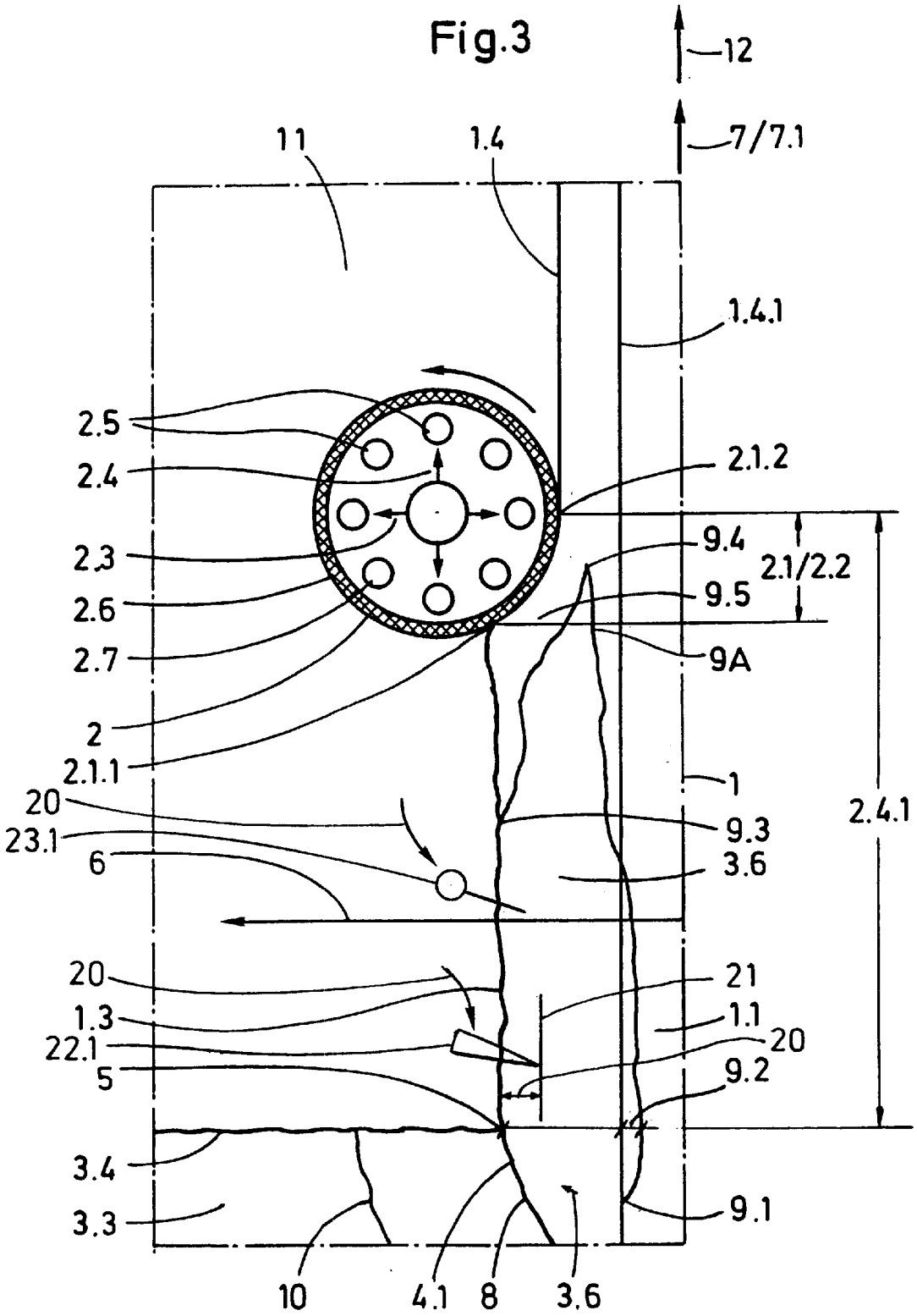

FIG. 3 illustrates the area of the smoothing roller pair 2 in more detail. The coated strip 1 with its layer 3.6 crystallized thereon exits the roller gap 2.1.1 with a surface temperature T-2.1.1 smaller than T-solidus (T-2.1.1<T-sol) and exits from the roller gap 2.1 at its exit 2.1.2 with a temperature T-2.1.2 smaller T-2.1.1 (T-2.1.2<T-2.1.1<T-sol) that has been lowered in a controlled fashion. The temperature loss in the roller gap should be controlled and kept small. This can be achieved according to the invention with a corresponding heat transfer-controlled smoothing roller pair 2 with inner cooling device 2.5 and heat-controlled layer 2.6 or layers.

For this purpose, the cooling action, the materials, and the thickness of the rollers 2, their layer configuration 2.6, and the selection of the different roller materials, for example, steel, metals, metal ceramics and/or ceramics, must be adjusted relative to one another.

The entire chamber 11 above the bath surface 3.4 is controlled with regard to its temperature and atmosphere (nitrogen and/or argon) so that the above described conditions can be ensured and an oxidation of the bath surface can be prevented.

The thus coated strip is supplied directly or indirectly to a further rolling mill 12 and rolling process for generating finished hot-rolled strips and/or cold-rolled strips in the form of a single material as well as a composite material with, but also without, pickling station arranged upstream.

For controlling, adjusting and/or regulating the temperature field within the coated strip 1 and on the strip surface 1.3 between the molten bath surface 3.4 and the exit of the coated and smoothed strip 1.4.1 from the smoothing roller pair 2, measuring devices for temperature measurement 2.8 are provided at the inner side of the heat controlled wall elements 6.2.

LIST OF REFERENCE NUMERALS

1. coated strip between the bath surface and the smoothing roller pair
1.1 mother strip, initial metal strip
1.2 thickness of the coated strip between bath surface and smoothing roller pair
1.3 rough, coated strip surface
1.4 planar, smoothed strip surface
1.4.1 coated and smoothed strip
1.5 drive roller pair underneath the crystallization device
1.6 detail, see FIG. 3
2. smoothing roller pair
2.1 roller gap
2.1.1 beginning of roller gap
2.1.2 end of roller gap
2.2 compressed length within the roller gap
2.3 position of the smoothing roller pair in the thickness direction of the strip, roller adjustment in the thickness direction
2.4 position of the smoothing roller pair in the casting and rolling direction of the strip
2.4.1 spacing of the smoothing roller pair to the bath surface
2.5 inner cooling device of the smoothing roller pair
2.6 coating of the smoothing roller pair for controlling the heat transfer
2.7 energy flow into the inner-cooled smoothing roller pair
2.8 measuring device for determining the strip surface temperature
3. crystallization device
3.1 molten mass inlet
3.2 jet of bottom inlet device
3.3 molten bath
3.3.1 molten bath level
3.4 bath surface
3.5 meniscus
3.6 crystallization of the molten mass
3.6.1 beginning of partial crystallization
4. energy flow in the molten bath from the molten mass into the mother strip
4.1 surface and profile of the partial crystallization in the molten bath
5. exit of the coated strip from the bath
5.1 final thickness of the partially crystallized layer
6. energy flow above the bath surface to the exterior to the walls with heat-controlled transfer
6.1 walls with heat-controlled transfer
6.2 heat transfer-controlled wall elements, independent of one another
7. casting and rolling direction
7.1 casting and rolling speed
8. surface temperature, T-x of the partial crystallization in the molten bath
9. isothermal line of the solidus temperature, solidification profile
9.1 beginning of the strip surface melting and the welding of the mother strip and the partial crystallization
9.2 maximum melting zone at the surface of the mother strip
9.3 beginning of the solidification starting at the strip surface in the direction toward the strip center, surface temperature equal to solidus temperature
9.4 end of solidification, complete solidification
9.5 solidified strip surface
9.A solidification profile, isothermal line of the solidus temperature, complete solidification at the latest at the end of the roller gap
9.B solidification profile, isothermal line of the solidus temperature, complete solidification at the latest at the point of entering the roller gap
10. isothermal line of the liquidus temperature
11. temperature-controlled and atmosphere-controlled chamber above the molten bath
12. rolling mill for direct further processing
20 stripping off the partial crystallization layer (3.6) with a thickness (1.2 to a smaller thickness (21)
21 smaller thickness of the partial crystallization layer (3.6) with a thickness (1.2)
22 mechanical stripping, for example, with a blade
22.1 mechanical stripping device, blade
22.2 pneumatic stripping device
23 pneumatic stripping, for example, with an oxygen-free gas jet (23.1)
24 "doughy" strip surface area (two phases: molten mass and crystal) between the bath surface (1.3) and the beginning of solidification (9.3) in the strip surface (1.3).

What is claimed is:

1. In a method for producing coated strands of metal, the method including guiding a metal strip through a bottom of a vessel filled with a molten mass of the same or different composition as the metal strip, wherein the residence time of the metal strip is selected as a function of a molten bath level, a casting speed, a metal strip thickness, and a preheating temperature of the metal strip such that deposited molten mass on the metal strand has a desired thickness of several times an initial thickness of the metal strip, subjecting the metal strip with a crystallized layer deposited thereon after exiting from the molten bath to a smoothing pass, wherein the smoothing pass is performed when a surface temperature of the crystallized layer is smaller than the solidus temperature of the molten bath, so that at least the surface of the crystallized layer is solidified, the improvement comprising applying the crystallized layer to the strip with a thickness exceeding the desired final thickness, and between the molten bath and the beginning of solidification in a still doughy state of crystallization, stripping the crystallized layer to a controlled smaller uniform thickness over the length of the strand.

2. The method according to claim 1, comprising carrying out stripping mechanically.

3. The method according to claim 1, comprising carrying stripping by means of a blade.

4. The method according to claim 1, comprising carrying out stripping pneumatically.

5. The method according to claim 1, comprising carrying out stripping with an oxygen-free gas jet.

6. A device for producing coated strands of metal, the device comprising a melting vessel with a crystallization device having a bottom with a bottom inlet device, wherein the crystallization device is configured to allow a mother strip driven by a drive roller pair to enter with formation of a meniscus in an area of the bottom inlet device, a chamber above a molten bath contained in the melting vessel, a smoothing roller pair with a roller gap arranged in the chamber for guiding therethrough the mother strip with a crystallized layer deposited thereon and solidified at a surface thereof, a stripping device for reducing a thickness of the crystallized layer to a smaller thickness between the molten bath and the beginning of solidification on the strip surface, wherein rolls of the chamber and the smoothing roller pair are configured to be heat-controlled.

7. The device according to claim 6, wherein the stripping device is a mechanical stripping device.

8. The device according to claim 7, wherein the mechanical stripping device is a blade.

9. The device according to claim 6, wherein the stripping device is a pneumatical stripping device.

10. The device according to claim 6, wherein a distance between the stripping device and the molten bath is variable.

* * * * *